US006802887B1

(12) United States Patent
Wieder et al.

(10) Patent No.: US 6,802,887 B1
(45) Date of Patent: Oct. 12, 2004

(54) METHOD AND DEVICE FOR FEEDING A GAS TO A METALLURGICAL VESSEL

(75) Inventors: Kurt Wieder, Schwertberg (AT); Johann Wurm, Ban Zell (AT); Mohamed Tarek El-Rayes, St. Florian (AT)

(73) Assignee: Voest-Alpine Industrieanlagenbau GmbH & Co. (AT)

( * ) Notice: Subject to any disclaimer, the term of this patent is extended or adjusted under 35 U.S.C. 154(b) by 154 days.

(21) Appl. No.: 10/168,393

(22) PCT Filed: Nov. 7, 2000

(86) PCT No.: PCT/EP00/10964

§ 371 (c)(1),
(2), (4) Date: Jun. 19, 2002

(87) PCT Pub. No.: WO01/46479

PCT Pub. Date: Jun. 28, 2001

(30) Foreign Application Priority Data

Dec. 20, 1999 (AT) ..... 2146/99

(51) Int. Cl.[7] ..... C21C 5/30
(52) U.S. Cl. ..... 75/528; 266/225; 266/268
(58) Field of Search ..... 266/225, 268; 75/528, 559, 547

(56) References Cited

U.S. PATENT DOCUMENTS

| | | | | |
|---|---|---|---|---|
| 3,269,829 A | * | 8/1966 | Belkin | 75/516 |
| 4,249,722 A | | 2/1981 | Jaquay | 266/172 |
| 4,455,166 A | | 6/1984 | Brancaz et al. | 75/60 |
| 4,655,647 A | | 4/1987 | Bock | 406/194 |
| 5,714,113 A | | 2/1998 | Gitman et al. | 266/182 |
| 5,997,596 A | | 12/1999 | Joshi et al. | 48/198.1 |

FOREIGN PATENT DOCUMENTS

| | | |
|---|---|---|
| DE | 2437644 | 3/1975 |
| DE | 2512947 | 10/1976 |
| DE | 19529932 | 1/1997 |
| EP | 0677704 | 10/1995 |
| EP | 0874194 | 10/1998 |
| FR | 2540519 | 8/1984 |
| GB | 1007241 | 10/1965 |
| GB | 1446612 | 8/1976 |
| WO | 00/28097 | 5/2000 |

* cited by examiner

*Primary Examiner*—Scott Kastler
(74) *Attorney, Agent, or Firm*—Ostrolenk, Faber, Gerb & Soffen, LLP

(57) ABSTRACT

A method is for feeding a gas into a metallurgical vessel having a condensable and/or evaporable component entrained by the gas. The gas is fed to the metallurgical vessel via one or more gas supply means. According to the method, if there are a number of the gas supply means, in a first section, the gas velocity is continuously increased, in a turbulence zone, the gas is intimately mixed with the condensable and/or evaporable component, in an exit section, the gas velocity is kept substantially constant, and the gas which has been intimately mixed with the entrained component is blown into the metallurgical vessel. A gas supply device for carrying out the method is also disclosed. The method and apparatus according t the invention make it possible to prevent or reduce nozzle damage.

15 Claims, 3 Drawing Sheets

Fig. 1: PRIOR ART
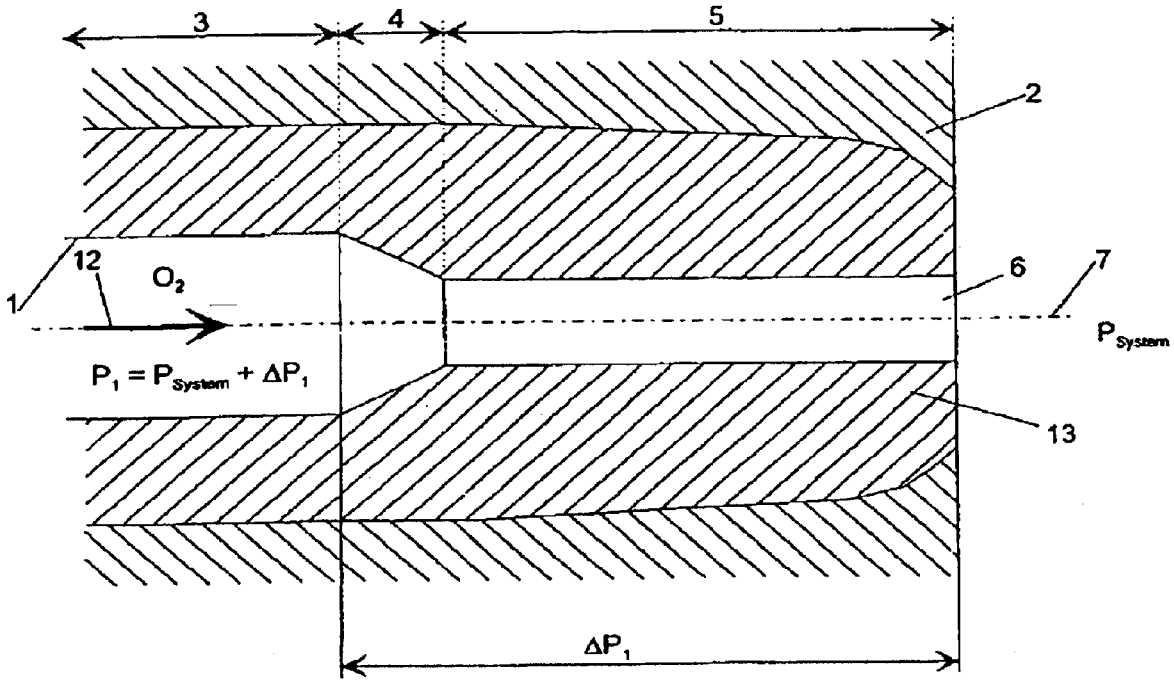
Fig. 2:
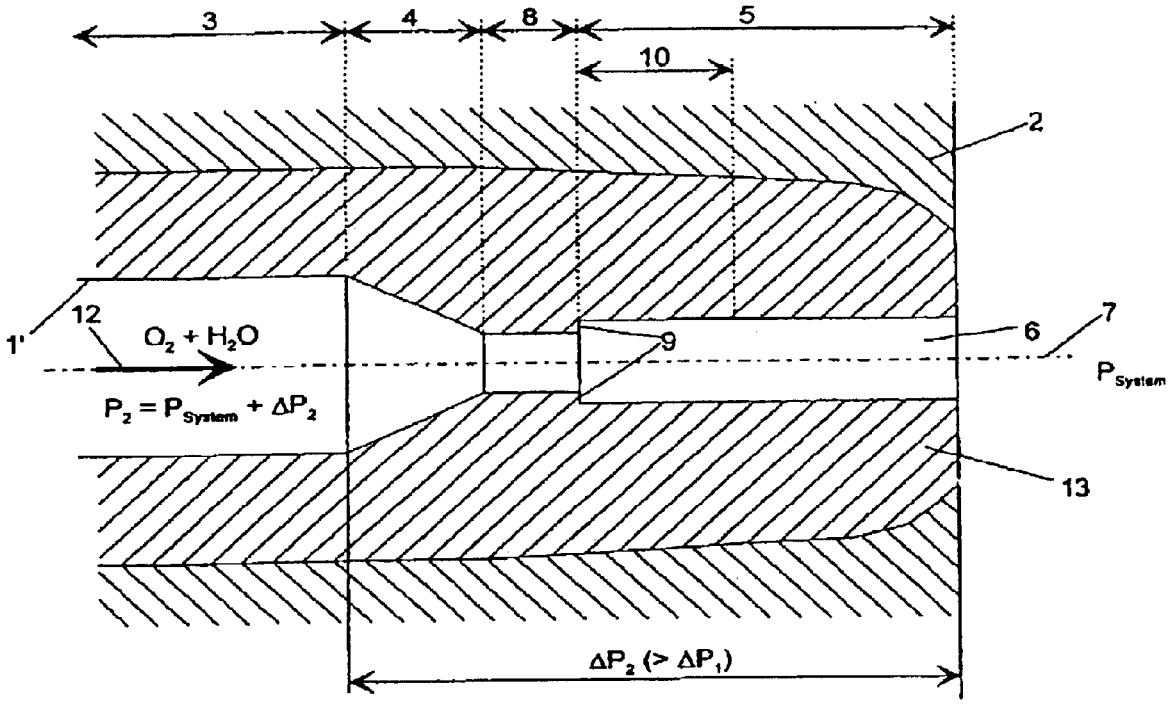

METHOD AND DEVICE FOR FEEDING A GAS TO A METALLURGICAL VESSEL

The invention relates to a method for feeding a gas into a metallurgical vessel, a condensable and/or evaporable component in the gaseous and/or liquid state being entrained by the gas, and the gas being fed to the metallurgical vessel via one or more gas supply means, and to a gas supply means for carrying out the method.

Metallurgical vessels, in particular melter gasifiers, are fed an oxygen-containing gas, for example air or oxygen-enriched air or technical-grade oxygen, via gas nozzles. For process control purposes and to influence the method, it is necessary for a condensable or evaporable component to be blown into the metallurgical vessel together with the corresponding gas. This component is generally formed by water or steam.

A melter gasifier is fed with steam in order to allow the flame temperatures at the oxygen nozzles to be influenced. Since steam is not always available, a further possibility is to supply liquid water in atomized form. In the case of water in the liquid state, as well as the endothermic gasification reaction ($H_2O+C \Longrightarrow H_2+CO$) which takes place in any case, the heat of evaporation which is to be applied after the water has been blown in additionally serves to influence the temperature.

However, with both measures there is a risk of water which has condensed or is still liquid flowing through the nozzle passage to the refractory material of the melter gasifier, where it can damage the masonry work. Early atomization does not solve this problem, since the water constantly reaches the inner wall of the nozzle passage, where it forms a film of water.

Therefore, the object of the present invention is to provide a method, of feeding gas which contains a condensable and/or evaporable component in the gaseous and/or liquid state entrained therein in which possible damage to the gas supply means is considerably reduced or prevented altogether.

This object is achieved by the fact that if there are a number of the gas supply means, in each of these gas supply means

- in a first section the gas velocity is continuously increased,
- in a turbulence zone the gas is intimately mixed with the condensable and/or evaporable component, and
- the gas which has been intimately mixed with the entrained component is blown into the metallurgical vessel.

If the component is originally used in the gaseous state, the method according to the invention reliably makes it possible to distribute liquid which has condensed out of the gas phase uniformly in the gas stream, since it is no longer possible for a film of liquid to be deposited in the turbulence zone. The flow conditions and temperatures which then prevail mean that it is also no longer possible for a film of liquid to be deposited again downstream of the turbulence zone.

The method according to the invention also allows the component to be used in the liquid state, for example to be sprayed into the gas stream. Costs can be saved by the absence of a separate evaporation step.

A preferred embodiment of the method according to the invention consists in the gas being formed by oxygen, in particular technical-grade oxygen, as is obtained, for example, from an air fractionation installation.

The condensable and/or evaporable component is preferably formed by steam or water.

According to a further advantageous embodiment, the gas velocity downstream of the first section and upstream of the turbulence zone is kept substantially constant for a period of time.

According to another advantageous embodiment, the gas velocity upstream of the first section is kept substantially constant for a period of time.

According to another embodiment, the gas velocity is kept substantially constant or falls slightly over the exit section.

The invention also relates to a gas supply means for feeding a gas into a metallurgical vessel, the gas supply means having a flow passage passing through it along a central longitudinal axis, and a condensable or evaporable component being entrained by the gas.

In this gas supply means, the intention is to considerably reduce or prevent altogether any possible damage during operation.

To achieve this object, according to the invention a gas supply means of this type is characterized in that the flow passage—starting from a defined cross section—has at least

- an abrupt cross-sectional widening in the flow passage, and
- an exit section which is arranged downstream of the cross-sectional widening, as seen in the direction of flow of the gas, and
- a narrowing section, which has a cross section of flow which narrows in the direction of flow of the gas, being arranged upstream of the cross-sectional widening in the direction of flow of the gas.

In this context, an abrupt cross-sectional widening is to be understood as meaning a sudden increase in the diameter of the flow passage which takes place in the direction of flow of the gas. As a result of the swirling and turbulence which occur in the gas, gas constituents which were not fully mixed with the gas by this point are intimately mixed with the gas. In addition, any liquid deposits on the inner wall of the flow passage are entrained thereby and are likewise distributed uniformly in the gas.

Neither for the method according to the invention nor for the gas supply means according to the invention is it necessary for all the sections of a gas supply means mentioned above and below to be structurally combined in a nozzle.

For example, it is possible for the first section or the narrowing section to be arranged upstream of the nozzle and for the exit section to be arranged downstream of the nozzle. The reduced service life of the nozzle and/or the refractory material resulting from this less optimal arrangement may nevertheless be adequate for certain applications. Thus, it should be understood that the gas supply means according to the invention is to be regarded in the most general sense as a gas supply system including one or more gas supply devices having operational characteristics as described herein, and to be inclusive of all physical realizations by which these operating characteristics are realized, in addition to those specifically described.

According to an advantageous configuration, an intermediate section of substantially constant cross section of flow is arranged between the narrowing section and the abrupt cross-sectional widening.

This intermediate section means that the abrupt cross-sectional widening is situated at an optimum distance—with a view to achieving optimum turbulence and to avoiding a film of liquid in the exit section—from the gas supply means opening which is on the melter gasifier side.

The abrupt cross-sectional widening is advantageously refined in such a manner that the increase in the cross section of flow at the abrupt cross-sectional widening has a mean inclination α—with respect to the longitudinal axis of the flow passage—of at least 60°, preferably of at least 75°.

With an inclination a of at least 60°, a step is formed on the inner wall of the flow passage, ensuring sufficient atomization of deposited or entrained liquid and then sufficient turbulence and mixing of the gas components.

It is particularly advantageous if the increase in the cross section of flow at the abrupt cross-sectional widening has a mean inclination α of substantially 90°.

90° does not represent the maximum upper limit for the inclination α; higher values for α under certain circumstances lead to expedient embodiments. Although higher values for α result in a sharper break-off edge, if α>90° this edge becomes worn more easily than if α≦90°.

According to one embodiment of the gas supply means according to the invention, an entry section of substantially constant cross section of gas flow is arranged upstream of the narrowing section, as seen in the direction of flow of the gas.

A further aspect of the present invention relates to a device for feeding a gas into a metallurgical vessel, the device comprising one or more gas supply means according to the invention, as well as gas feed lines leading to the gas supply means and means for introducing a condensable or evaporable component into the gas supply means.

To make it possible to benefit from the advantages of the invention, it should not be necessary to completely exchange existing nozzles for gas supply means according to the invention. Rather, it is to be possible, in a simple and inexpensive way, to convert existing nozzles to form gas supply means according to the invention.

Therefore, the invention also relates to an insert piece for converting a nozzle which is known from the prior art, the nozzle passage of which has at least an exit section, and a narrowing section, which is arranged upstream of the exit section and which—towards the cross section of the exit section—is designed to taper in the direction of flow of the gas.

An insert piece of this type is characterized in that a gas flow passage is guided through the insert piece along an axis which—with the insert piece having been inserted into the nozzle—coincides with the central longitudinal axis of the nozzle, at least a partial region of the inner contour of the narrowing section being reproduced by the outer contour of the insert piece, the cross section of the gas flow passage being designed to narrow in the direction of flow of the gas, and the outlet opening being provided with a break-off edge, with the result that—with the insert piece having been inserted into the nozzle—an abrupt cross-sectional widening arranged downstream of the narrowing section, as seen in the direction of flow of the gas, is formed in the gas flow passage.

Accordingly, in this context the term break-off edge is to be understood as meaning, mutatis mutandis, the designs given above in relation to the abrupt cross-sectional widening.

The insert piece described above can easily be pushed into an existing nozzle, for example during a maintenance shut down with the gas feed line removed. Since the outer contour of the insert piece is accurately shaped to match the inner contour of the nozzle passage, and specifically in particular of the narrowing section or at least a part thereof, when the nozzle begins operation the insert piece is pressed against the narrowing section by the gas pressure.

The gas flow passage, or its part which narrows in the direction of flow of the gas, then forms the narrowing section of the converted nozzle, while the break-off edge of the insert piece forms the abrupt cross-sectional widening of the nozzle.

Advantageously, the outer contour of the insert piece additionally reproduces a partial region of the inner contour of the exit section, the inner contour of which then forms the intermediate section of the converted nozzle.

As an alternative or in addition, according to an advantageous embodiment the outer contour of the insert piece reproduces a partial region of the entry section.

Depending on which additional partial regions of sections are reproduced by the outer contour of the insert piece, either the location of the break-off edge or the abrupt cross-sectional widening is thereby determined in the converted nozzle, and/or a part created is overall more solid, easier to handle and can be inserted accurately into the nozzle.

Compared to nozzles which are known from the prior art, nozzles of the device according to the invention have a smaller cross section immediately upstream of the abrupt cross-sectional increase. Consequently, the admission pressure in the feed line which supplies the nozzle is higher than in the prior art, and therefore—if the supply pressure is constant—the pressure difference at the flow-regulating member, which is situated upstream of the nozzles, is lower. This flow-regulating member, which for all the nozzles restricts the supply pressure in a common supply line to the admission pressure prevailing in the feed lines, always has the drawback of producing large amounts of noise. Since the pressure difference between supply pressure and admission pressure is now lower, the noise is also reduced.

A further advantage of the invention consists in the fact that the system overall becomes harder, i.e. a higher pressure prevails immediately upstream of the narrowest nozzle cross section, with the result that, when liquid phase, e.g. liquid pig iron, penetrates into the nozzle, it is removed again more quickly and thus nozzle damage is reduced.

The invention is explained in more detail below with reference to the exemplary embodiments illustrated in FIGS. 1 to 5.

FIG. 1 shows a cross section through a nozzle according to the prior art,

FIG. 2 shows a cross section through a nozzle according to the invention,

Figure 5:
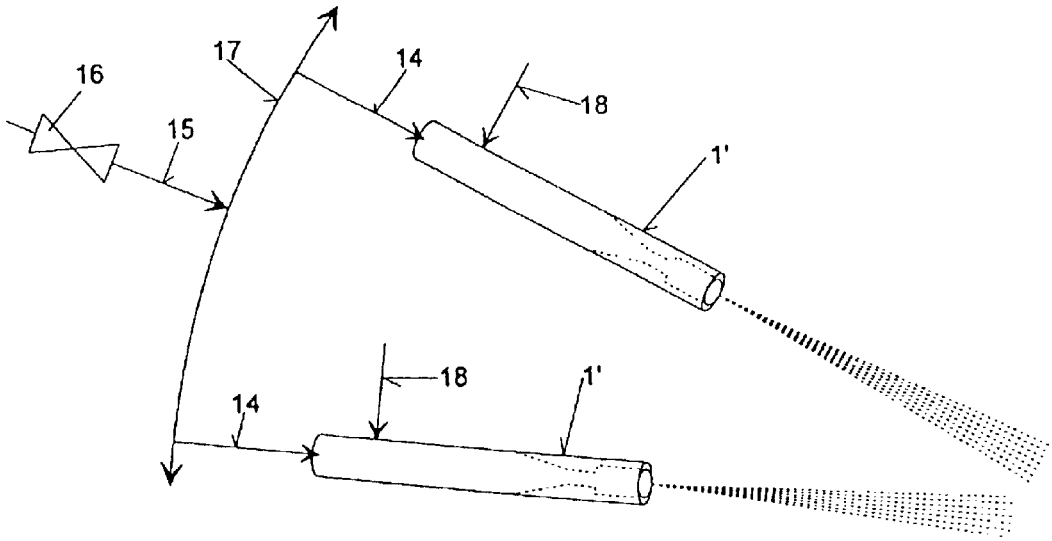

FIG. 5 diagrammatically depicts a part of the overall device for blowing in a gas.

In FIG. 1, a nozzle 1 passes through the shell 2 of a metallurgical vessel, for example a melter gasifier. The nozzle 1 is formed by a water-cooled nozzle body 13. A nozzle passage 6, which comprises a plurality of sections 3, 4, 5 and is substantially rotationally symmetrical with respect to a central longitudinal axis 7 of the nozzle passage 6, is guided through the nozzle body 13.

The entry section 3 is of substantially constant cross section, this cross section then being reduced continuously, as seen in the direction of flow 12 of the gas, in a subsequent narrowing section 4. In an exit section 5, the cross section of flow is kept substantially constant until the gas flows into the melter gasifier.

In the entry section 3, the admission pressure $P_1$ prevails, and over the entire remaining length of the nozzle passage 6 this pressure drops to the internal system pressure $P_{system}$ by the pressure different $\Delta P^1$.

The nozzle 1' illustrated in FIG. 2 likewise has an entry section 3 of substantially constant cross section of flow, which, in a narrowing section 4, is continuously reduced in the direction of flow 12 of the gas. In this case, the narrowing section 4 is adjoined by an intermediate section 8 of uniform cross section. The intermediate section 8 is followed by an abrupt cross-sectional widening 9, which in the drawing is designed as a right-angled recess 9 in the nozzle inner wall. In this context, it is essential that the step formed by the recess 9 should not be too high, i.e. that the difference between the two diameters upstream and downstream of the recess 9 should not be too great, so that the pressure loss does not become too high. Furthermore, it is essential that the recess 9 be provided with a sharp break-off edge, in order to ensure sufficient atomization.

A ratio of the two diameters of 1:1.05 to 1:1.25 has proven particularly advantageous.

The abrupt cross-sectional widening 9 is adjoined by an exit section 5 which once again is of substantially constant cross section, the zone which immediately adjoins the cross-sectional widening 9 forming the turbulence zone 10, in which gas and entrained component are intimately mixed.

In this case, the admission pressure $P_2$ prevails in the entry section 3 and drops over the entire remaining length of the nozzle passage 6 to the internal system pressure $P_{system}$ by the pressure difference $\Delta P_2$. However, $\Delta P_2$ is greater than $\Delta P_1$, so that therefore $P_2 > P_1$ and therefore the pressure difference between $P_2$ and the supply pressure (which like $P_{system}$ is identical in both cases) is lower than in the prior art.

Figure 3:
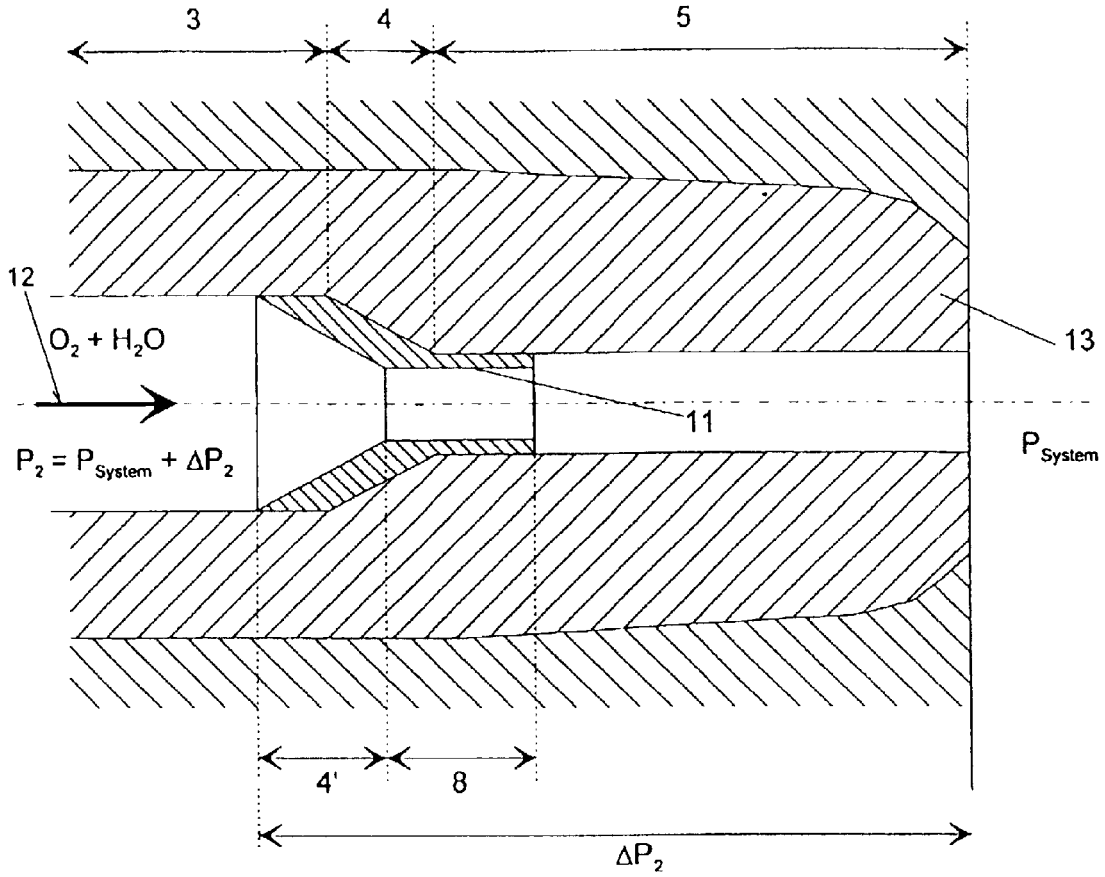
FIG. 3 shows a cross section through a nozzle according to the prior art which has been modified by means of an insert.

The nozzle 1 illustrated in FIG. 3 has an insert 11, which is used to convert a nozzle as illustrated in FIG. 1 to a nozzle 1' according to the invention.

The outer contour of the insert piece 11 accurately reproduces the inner contour of the entire original narrowing section 4 and in each case a part of the entry section 3 and exit section 5. The inner contour of the insert piece 11 is designed in such a manner that it once again has a narrowing section 4' and an intermediate section 8.

Nozzles 1 can be retrofitted in a simple manner during a maintenance shutdown of the melter gasifier, during which the insert is pushed into the nozzle passage 6 from the outside when the feed line has been removed.

Figure 4:
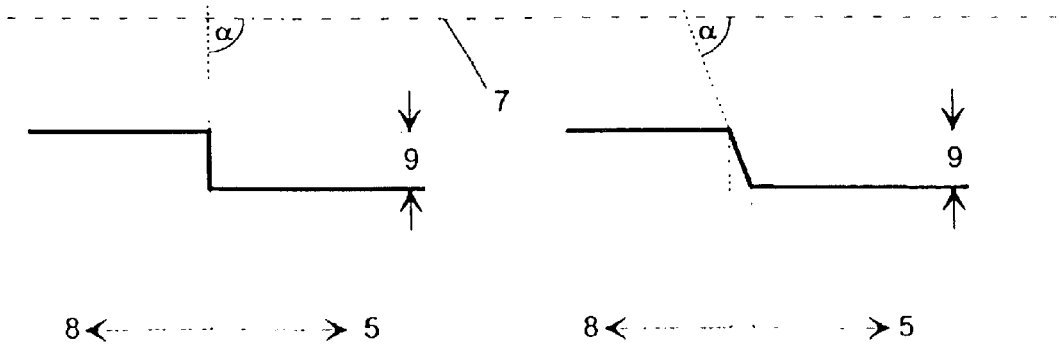
FIG. 4 shows variant designs of the cross-sectional widening.

FIG. 4 shows two variant designs of the cross-sectional widening in detail, with the increase in the cross section of flow in FIG. 4*a* having an inclination a of 90° with respect to the longitudinal axis 7 and in FIG. 4*b* having an inclination $\alpha$ of 70° with respect to the longitudinal axis 7.

In FIG. 5, by way of example, two nozzles 1' of the approximately 20 to 30 oxygen nozzles which pass through the shell of a melter gasifier at a certain height and at an approximately even distance from one another. Each of the nozzles 1' is provided with at least one gas feed line 14, through which the nozzle 1' is supplied with oxygen or oxygen-containing gas.

In a common supply line 15, a flow-regulating member 16 restricts the oxygen supply pressure to the admission pressure which prevails in the ring pipeline 17 and the gas feed lines 14, i.e. in this case $P_2$. The ring pipeline 17 then also supplies all the other gas feed lines (not shown in the drawing here), or nozzles, with oxygen. The nozzles 1' are provided with a means 18 for the introduction of water or steam. In the most simple scenario, this means 18 is designed as a water or steam line which opens into the nozzle passage.

The direction in which the water or steam is introduced may expediently be either in, opposite to or perpendicular to the direction of flow of the gas inside the nozzle passage. Preferably, water is injected into the nozzle passage in the direction of flow of the gas inside the nozzle passage.

The invention is not restricted to the exemplary embodiments illustrated in the figures, but rather also encompasses all means which are known to the person skilled in the art which can be used to embody the invention.

What is claimed is:

1. A method for feeding a gas into a metallurgical vessel, the gas having a condensable component in the gaseous state and/or an evaporable component in the liquid state entrained therein, and the gas being fed to the metallurgical vessel via one or more gas supply devices, the method comprising the steps of:

operating each gas supply device to continuously increase the velocity of the gas in a first zone thereof;

intimately mixing the gas with the condensable or evaporable component in a turbulence zone of each gas supply device, the turbulence zone being provided by an abrupt cross-sectional widening of a gas supply device having a single flow passage the increase in the cross section of flow at the abrupt cross-sectional widening having a mean inclination $\alpha$ a with respect to the longitudinal axis of the flow passage of at least 60°; and after the gas has been intimately mixed with the entrained component, blowing the mixture into the metallurgical vessel via an exit zone of each gas supply device.

2. A method according to claim 1, wherein the condensable and/or evaporable component is comprised of steam or water.

3. A method according to claim 1, wherein, downstream of the first section and upstream of the turbulence zone, the gas velocity is kept substantially constant for a period of time.

4. A method according to claim 1, wherein, upstream of the first section, the gas velocity is kept substantially constant for a period of time.

5. A method according to claim 1, wherein the gas velocity is kept substantially constant or falls slightly as it passes through the exit section.

6. Method according to claim 1, wherein the gas is comprised of technical-grade oxygen.

7. A method according to claim 1, wherein the gas includes oxygen as a component thereof.

8. A gas supply device for feeding a gas into a metallurgical vessel according to the method of claim 1, the gas supply device having a single flow passage passing through it along a central longitudinal axis wherein the flow passage—starting from a defined cross section includes:

an abrupt cross sectional widening thereof for imparting turbulence to and intimately mixing the condensable and/or evaporable liquid with the gas, the increase in the cross section of flow at the abrupt cross-sectional widening having a mean inclination $\alpha$ with respect to the longitudinal axis of the flow passage of at least 60°; and an exit section which is located downstream of the cross-sectional widening as seen in the direction of flow of the gas, and a narrowing section which has a cross section of flow which narrows in the direction of flow of the gas, located upstream of the cross-sectional widening.

9. A gas supply device according to claim 8, wherein an intermediate section of substantially constant cross section of flow is arranged between the narrowing section and the abrupt cross-sectional widening.

10. A gas supply device according to claim 8, wherein the increase in the cross section of flow at the abrupt cross-sectional widening (9) has a mean inclination $\alpha$ with respect to the longitudinal axis of the flow passage of at least 75°.

11. A gas supply device according to claim 8, wherein the increase in the cross section of flow at the abrupt cross-sectional widening has a mean inclination $\alpha$ of substantially 90°.

12. Device for feeding a gas into a metallurgical vessel, the device comprising:

one or more gas supply gas supply devices according to claim 8;

respective gas feed lines leading to the gas supply devices; and respective delivery devices coupled to introduce a condensable or evaporable component into the gas supply devices.

13. A nozzle insert for a device for feeding gas to a metallurgical vessel comprising: an exit section; and a narrowing section which is located upstream of the exit section, and which tapers in the direction of flow of the gas;

the insert having a gas flow passage which, when the insert is installed into the nozzle, coincides with the central longitudinal axis of the nozzle; wherein:

at least a partial region of the inner contour of the narrowing section is reproduced by the outer contour of the insert;

the cross section of the gas flow passage narrows in the direction of flow of the gas; and the outlet opening of the gas flow passage includes a break-off edge, whereby, with the insert piece installed into the nozzle, an abrupt cross-sectional widening downstream of the narrowing section is formed in the gas flow passage, the increase in the cross section of flow at the abrupt cross-sectional widening having a mean inclination $\alpha$ with respect to the longitudinal axis of the flow passage of at least 60°.

14. A nozzle insert according to claim 13, wherein the outer contour of the insert additionally reproduces a partial region of the inner contour of the exit section.

15. A nozzle insert according to claim 8, further including an entry section located upstream of the narrowing section, as seen in the direction of flow of the gas, wherein the outer contour of the insert additionally reproduces a partial region of the inner contour of the entry section.

* * * * *

UNITED STATES PATENT AND TRADEMARK OFFICE

CERTIFICATE OF CORRECTION

PATENT NO. : 6,802,887 B1 
DATED : October 12, 2004
INVENTOR(S) : Kurt Wieder, Johann Wurm and Mohamed Tarek El-Rayes It is certified that error appears in the above-identified patent and that said Letters Patent is hereby corrected as shown below:

Title page,
Item [75], Inventors, should read -- Kurt Wieder, Schwertberg (AT); Johann Wurm, Bad Zell (AT); Mohamed Tarek El-Rayes, St. Florian (AT) --.

Signed and Sealed this

Nineteenth Day of April, 2005

JON W. DUDAS
*Director of the United States Patent and Trademark Office*